US011167872B2

(12) United States Patent
Kato

(10) Patent No.: US 11,167,872 B2
(45) Date of Patent: Nov. 9, 2021

(54) ROTARY PACKAGING MACHINE

(71) Applicants: GENERAL PACKER CO., LTD., Aichi (JP); Kazuki Kato, Kitanagoya (JP)

(72) Inventor: Kazuki Kato, Kitanagoya (JP)

(73) Assignee: GENERAL PACKER CO., LTD., Aichi (JP)

( * ) Notice: Subject to any disclaimer, the term of this patent is extended or adjusted under 35 U.S.C. 154(b) by 199 days.

(21) Appl. No.: 16/319,900

(22) PCT Filed: May 16, 2017

(86) PCT No.: PCT/JP2017/018307

§ 371 (c)(1),
(2) Date: Jan. 23, 2019

(87) PCT Pub. No.: WO2018/020784

PCT Pub. Date: Feb. 1, 2018

(65) Prior Publication Data

US 2019/0217982 A1 Jul. 18, 2019

(30) Foreign Application Priority Data

Jul. 29, 2016 (JP) ..... 2016-149638

(51) Int. Cl.
*B65B 1/04* (2006.01)
*B65B 3/04* (2006.01)
(Continued)

(52) U.S. Cl.
CPC ..... *B65B 43/28* (2013.01); *B65B 43/46* (2013.01); *B65B 43/465* (2013.01); *B65B 43/50* (2013.01);
(Continued)

(58) Field of Classification Search
CPC ..... B65B 43/28; B65B 43/42; B65B 43/46; B65B 43/465; B65B 43/50
(Continued)

(56) References Cited

U.S. PATENT DOCUMENTS 5,182,898 A * 2/1993 Tung ..... B65B 43/465 493/475
5,845,466 A 12/1998 Laudenberg
(Continued)

FOREIGN PATENT DOCUMENTS

JP 8-156918 A 6/1996
JP 2002-068137 A 3/2002
(Continued)

OTHER PUBLICATIONS

International Search Report and Written Opinion for PCT Patent App. No. PCT/JP2017/018307 dated Aug. 22, 2017 with English translation of the ISR.
(Continued)

*Primary Examiner* — Thanh K Truong
*Assistant Examiner* — Patrick B Fry
(74) *Attorney, Agent, or Firm* — Cermak Nakajima & McGowan LLP; Tomoko Nakajima

(57) ABSTRACT

Providing a rotary packaging machine which can improve production efficiency and mass productivity, which can be rendered smaller-sized with the result of reduction in a footprint and which can cause various devices and apparatuses arranged at each packaging station to function in a stable manner. The rotary packaging machine P in accordance with the invention has four grip pairs intermittently moved to each packaging station simultaneously, and all the grip pairs include grips configured to be located on a circumference L of an imaginary circle that is concentric with a disk-shaped rotating body.

4 Claims, 12 Drawing Sheets

(51) Int. Cl.

| | |
|---|---|
| ***B65B 31/04*** | (2006.01) |
| ***B65B 43/28*** | (2006.01) |
| ***B65B 43/30*** | (2006.01) |
| ***B65B 43/34*** | (2006.01) |
| ***B65B 43/46*** | (2006.01) |
| ***B65B 43/50*** | (2006.01) |
| ***B65B 43/56*** | (2006.01) |
| ***B65B 51/14*** | (2006.01) |
| ***B65B 51/22*** | (2006.01) |
| ***B65B 51/32*** | (2006.01) |
| ***B65B 61/02*** | (2006.01) |

(52) U.S. Cl.
CPC ..... *B65B 43/56* (2013.01); *B65B 1/04* (2013.01); *B65B 3/04* (2013.01); *B65B 31/041* (2013.01); *B65B 43/30* (2013.01); *B65B 43/34* (2013.01); *B65B 51/146* (2013.01); *B65B 51/225* (2013.01); *B65B 51/32* (2013.01); *B65B 61/025* (2013.01); *B65B 2220/14* (2013.01)

(58) Field of Classification Search
USPC ..... 53/202, 272
See application file for complete search history.

(56) References Cited

U.S. PATENT DOCUMENTS

| | | | | |
|---|---|---|---|---|
| 8,562,274 | B2 * | 10/2013 | Murray | B65B 39/007 414/222.02 |
| 9,221,568 | B2 * | 12/2015 | Nakamoto | B65B 43/50 |
| 9,221,569 | B2 * | 12/2015 | Nakamoto | B65G 17/323 |
| 9,987,754 | B2 * | 6/2018 | Yoshikane | B65B 59/005 |
| 9,988,167 | B2 * | 6/2018 | Murray | B65G 29/00 |
| 2012/0240531 | A1 * | 9/2012 | Kawamura | B65B 39/12 53/572 |

FOREIGN PATENT DOCUMENTS

| | | | |
|---|---|---|---|
| JP | 2004-161384 | A | 6/2004 |
| KR | 10-0940880 | B1 | 2/2010 |

OTHER PUBLICATIONS

English translation of Official Action from Russian Patent App. No. 2019105011 dated Mar. 27, 2020.
Notification of Reasons for Refusal for Japanese Patent App. No. 2016-149639 dated Jan. 21, 2020.
Office Action from Polish Patent App. No. P.429599 dated Aug. 12, 2020 with partial English language translation thereof.

* cited by examiner

ROTARY PACKAGING MACHINE

This application is a national phase entry under 35 U.S.C. § 371 of PCT Patent Application No. PCT/JP2017/018307, filed on May 16, 2017, which is incorporated by reference.

TECHNICAL FIELD

The present invention relates to a rotary packaging machine which fills a packaging bag with an article to be packaged, such as food, and thereafter seals a bag mouth, thereby mass-producing products.

BACKGROUND ART

There have conventionally been most frequently used rotary packaging machines in which grip pairs are intermittently moved to packaging stations together with a disk-shaped rotating body while holding vicinities of both sides of a bag mouth of a packaging bag, whereby articles to be packaged are packaged. Furthermore, as the aforementioned type of rotary packaging machine, a rotary packaging machine has been suggested in which two grip pairs are intermittently moved to packaging stations simultaneously for improvement of production efficiency and mass productivity (for example, a packaging machine disclosed in Japanese Patent No. 5481722).

However, as illustrated in FIG. 1 of the aforementioned Patent No. 5481722, the grip pairs are mounted on the disk-shaped rotating body so that a plurality of grip pairs (two grip pairs or four grips in total in this figure) are colinearly aligned in a planar view.

As illustrated in FIG. 10 of this application, four pairs of grips 61 are mounted on a disk-shaped rotating body 62 so as to be colinearly aligned in the same manner as in the case of two grip pairs in order that the grips 61 may be simultaneously moved to packaging stations for improvement of production efficiency and mass productivity. In this case, a difference is increased between a radius of inner arc R1 on which innermost clips 63*a* and 63*b* are located and a radius of outer arc R2 on which outermost clips 63*c* and 63*d* are located, so that the rotary packaging machine is accordingly rendered large-sized with the result of increase in a footprint thereof and various devices and apparatuses arranged at each packaging station cannot stably function.

More specifically, for example, as illustrated in FIG. 11, a problem of non-uniform print quality arises since a distance from a packaging bag A held by the paired grips 61 to an ink-jet printer 70 changes in a printing step. Furthermore, for example, as illustrated in FIG. 12, a problem of low inspection accuracy arises in a print inspection step since a distance from the packaging bag A held by the paired grips 61 to a camera 71 changes. Still furthermore, since the packaging bags A at both sides of the alignment are increased in vibration due to influences of a centrifugal force and the articles are accordingly moved up and down in the packaging bags A, the packaging bags A get lighter or heavier with the result of a problem of low weighing accuracy.

PRIOR ART DOCUMENT

Patent Documents

Patent Document 1: Japanese Patent No. 5481722

SUMMARY OF THE INVENTION

Problem to Be Overcome by the Invention

An object of the present invention is to provide a rotary packaging machine which can improve the production efficiency and the mass productivity, which can be rendered smaller-sized with the result of reduction in the footprint thereof and which can cause various devices and apparatuses arranged at each packaging station to function in a stable manner.

Means for Overcoming the Problem

To achieve the object, the invention provides a rotary packaging machine in which a grip pair holding vicinities of both sides of a bag mouth of a packaging bag is intermittently moved to each of packaging stations together with a disk-shaped rotating body, so that an article is packaged in the packaging bag. The rotary packaging machine includes four grip pairs intermittently moved to each packaging station simultaneously. In the rotary packaging machine, all the grip pairs include grips are configured to be located on a circumference of an imaginary circle that is concentric with the disk-shaped rotating body (claim 1). The grip pairs may be mounted so that a midpoint of the packaging bag held by the grips of the grip pairs in a planar view is located on the circumference of the imaginary circle that is concentric with the disk-shaped rotating body.

Effect of the Invention

The above-described rotary packaging machine can improve the production efficiency and the mass productivity, can be rendered smaller-sized with the result of reduction in the footprint thereof and can cause various devices and apparatuses arranged at each packaging station to function in a stable manner.

BEST MODE FOR CARRYING OUT THE INVENTION

The present invention realizes a rotary packaging machine which has four grip pairs 31 intermittently moved to each packaging station simultaneously and in which grips 50 of all the grip pairs 31 are configured to be located on a circumference L of an imaginary circle that is concentric with a disk-shaped rotating body 32. Consequently, the rotary packaging machine can improve the production efficiency and the mass productivity, can be rendered smaller-sized with the result of reduction in the footprint thereof and can cause various devices and apparatuses arranged at each packaging station to function in a stable manner.

First Embodiment

Figure 1:
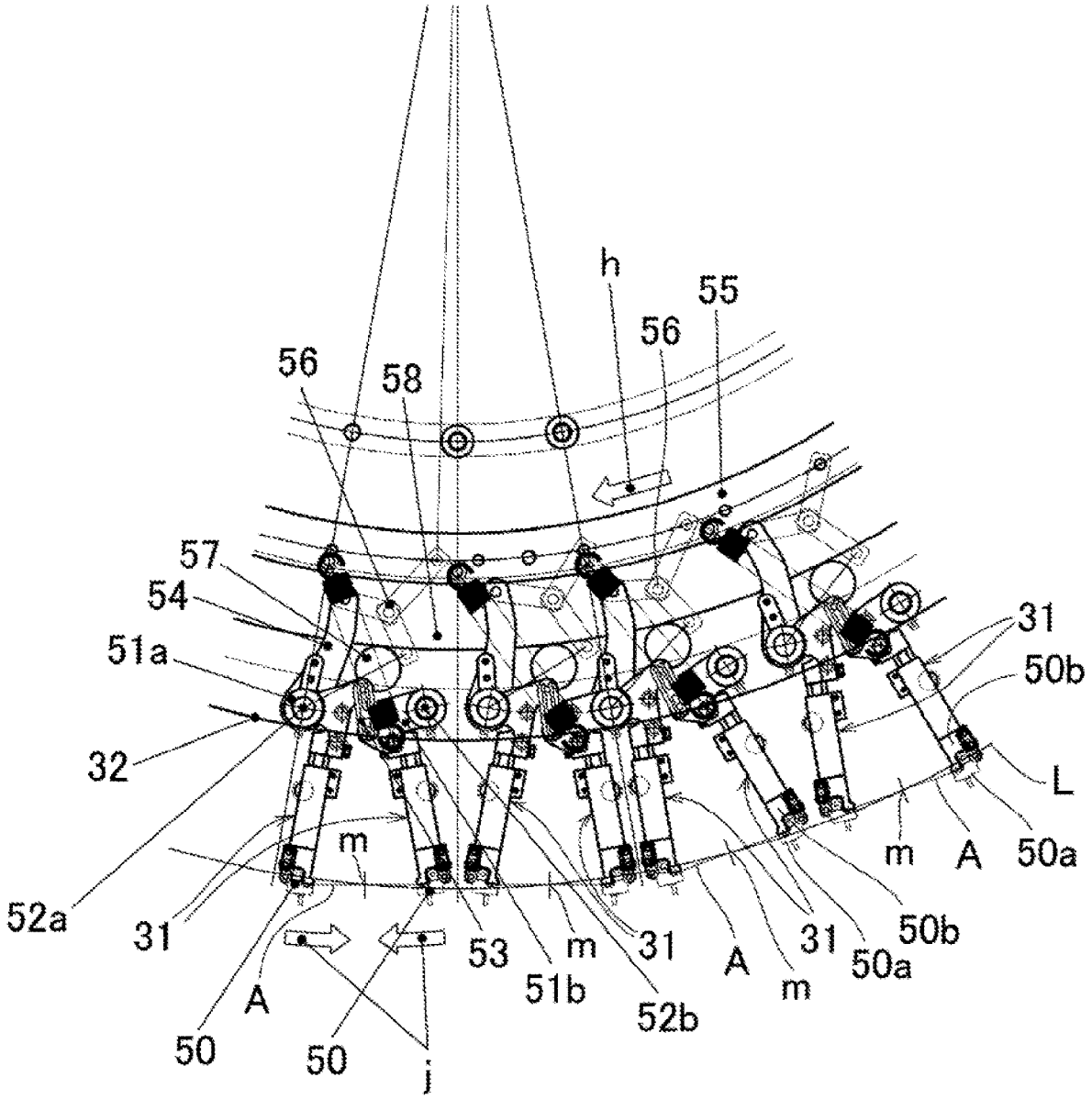
FIG. 1 is a partially enlarged plan view of the rotary packaging machine of an embodiment in accordance with the invention.

An embodiment of the rotary packaging machine in accordance with the present invention will be described with reference to FIGS. 1 to 9. The rotary packaging machine P of the embodiment is a rotary packaging machine in which grip pairs 31 respectively holding vicinities of both sides of a bag mouth of a packaging bag A are intermittently moved to each packaging station together with a disk-shaped rotating body 32, whereby articles to be packaged are packaged. The rotary packaging machine P has four grip pairs 31 intermittently moved to respective packaging stations 1 to 9 simultaneously, and grips 50 of all the grip pairs 31 are configured to be located on a circumference L of an imaginary circle that is concentric with a disk-shaped rotating body 32, as illustrated in FIG. 1. The construction of the rotary packaging machine P will be described in detail.

Figure 4:
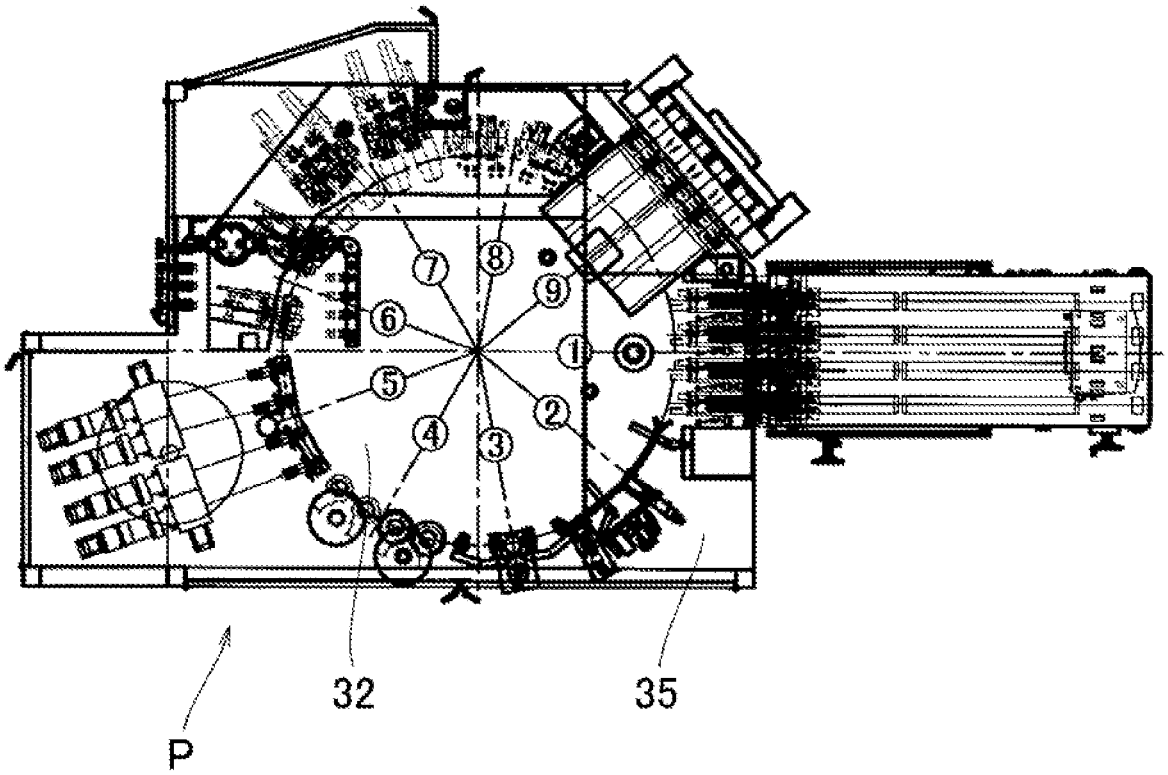
FIG. 4 is a plan view of the rotary packaging machine.

The rotary packaging machine P of the embodiment is provided for mass-producing retort food, and four packaging bags A respectively held by four grip pairs 31 are intermittently moved to each of nine stations simultaneously, as illustrated in FIG. 4, during which movement retort food is mass-produced.

Figure 5:
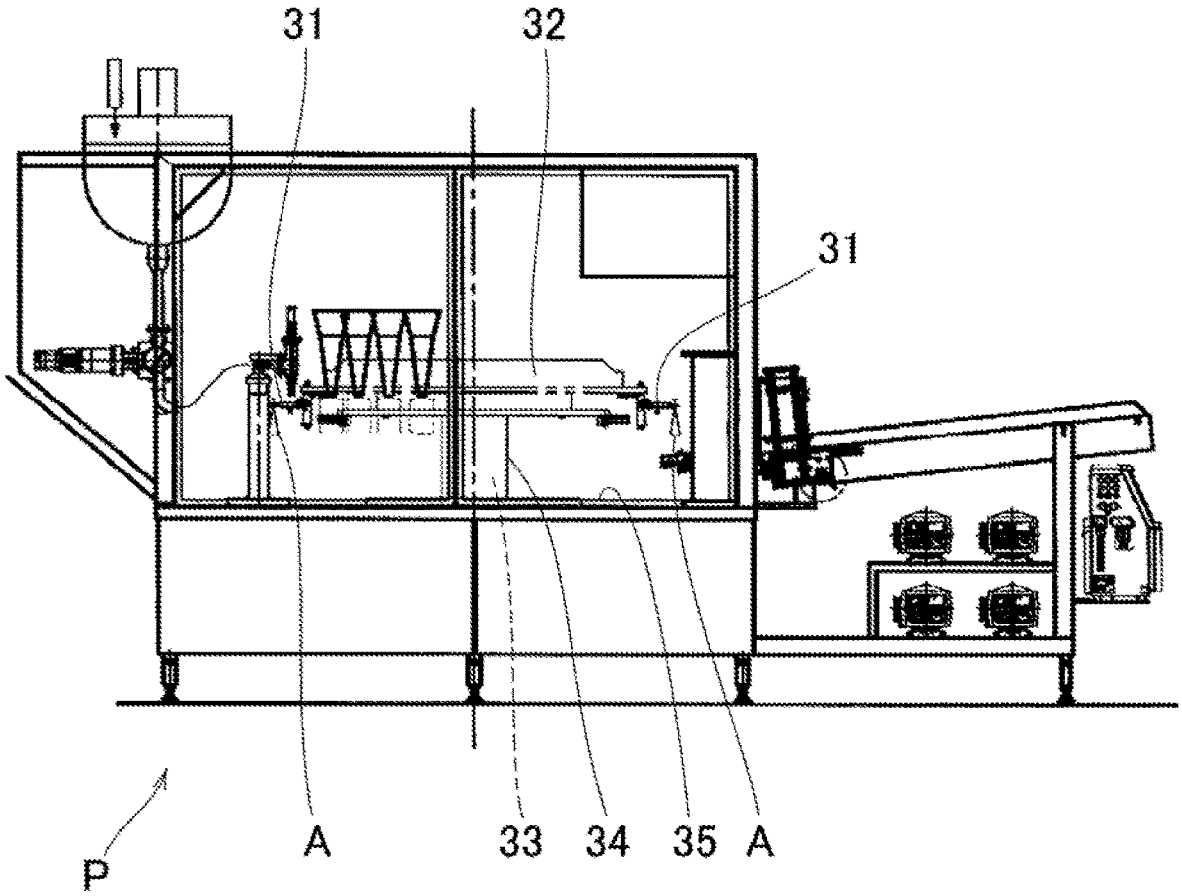
FIG. 5 is a front view of the rotary packaging machine.
Figure 6:
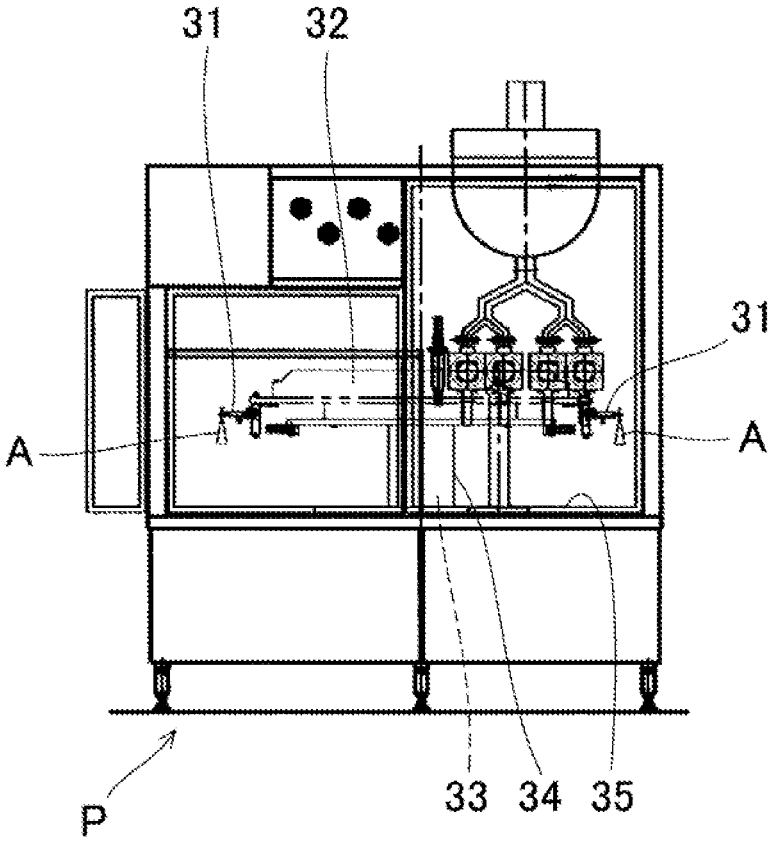
FIG. 6 is a left side view of the rotary packaging machine.
Figure 7:
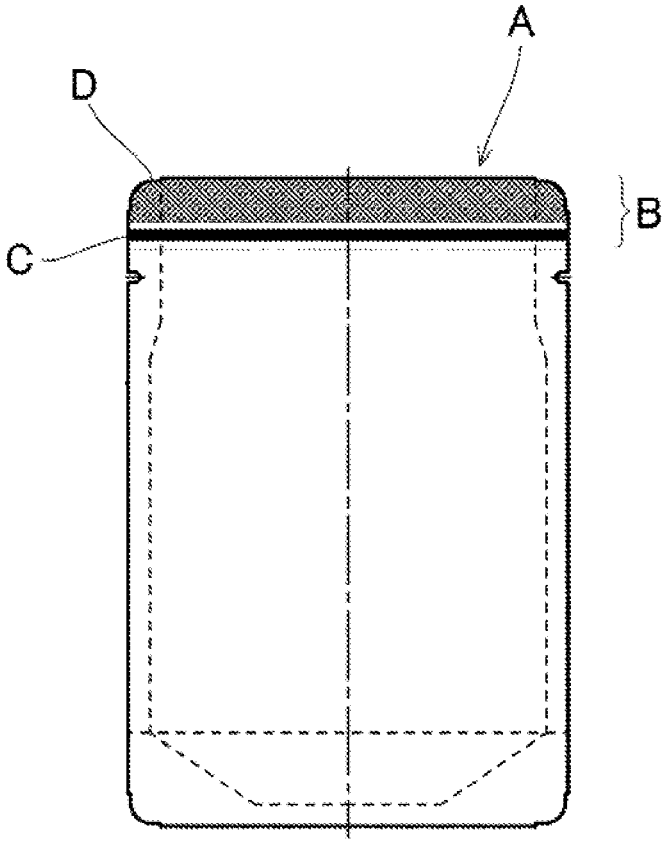
FIG. 7 is a diagrammatic view of an example of packaging bag to be supplied to the rotary packaging machine.

The rotary packaging machine P includes a stand 34 rotatably supporting a vertically-extending intermittent rotating shaft 33 mounted on a machine base 35, as illustrated in FIGS. 5 and 6. The rotary packaging machine P also includes a disk-shaped rotating body 32 mounted on an upper part of the intermittent rotating shaft 33. Four grip pairs 31 for gripping or releasing respective packaging bags A are provided on the disk-shaped rotating body 32 so as to project in a radiation direction at equiangular intervals about the intermittent rotating shaft 33. The grip pairs 31 are intermittently rotationally moved together with the disk-shaped rotating body 32 in every packaging process while respectively holding the vicinities of both sides of the bag mouths of the packaging bags A.

The rotary packaging machine P has four grip pairs 31 which are intermittently moved to each of the packaging stations 1 to 9 simultaneously and disposed at the same horizontal level. Grips 50 (36 pairs) of all the grip pairs 31 (four pairs×9 stations=36 pairs) are configured to be located on the circumference L of the imaginary circle that is concentric with the disk-shaped rotating body 32. As a result, since the articles are simultaneously packaged in a multiple of packaging bags by four grip pairs 31, the production efficiency and the mass productivity can be improved. Furthermore, the rotary packaging machine can be rendered smaller-sized with the result of reduction in the footprint thereof, and various devices and apparatuses arranged at each packaging station can function in a stable manner. Furthermore, since the difference between the inner and outer circular arcs where the grips 50 are located is almost eliminated, the rotary packaging machine P can be rendered smaller-sized and the footprint can be further reduced. Still furthermore, various devices and apparatuses disposed at each station can stably function.

Figure 8:
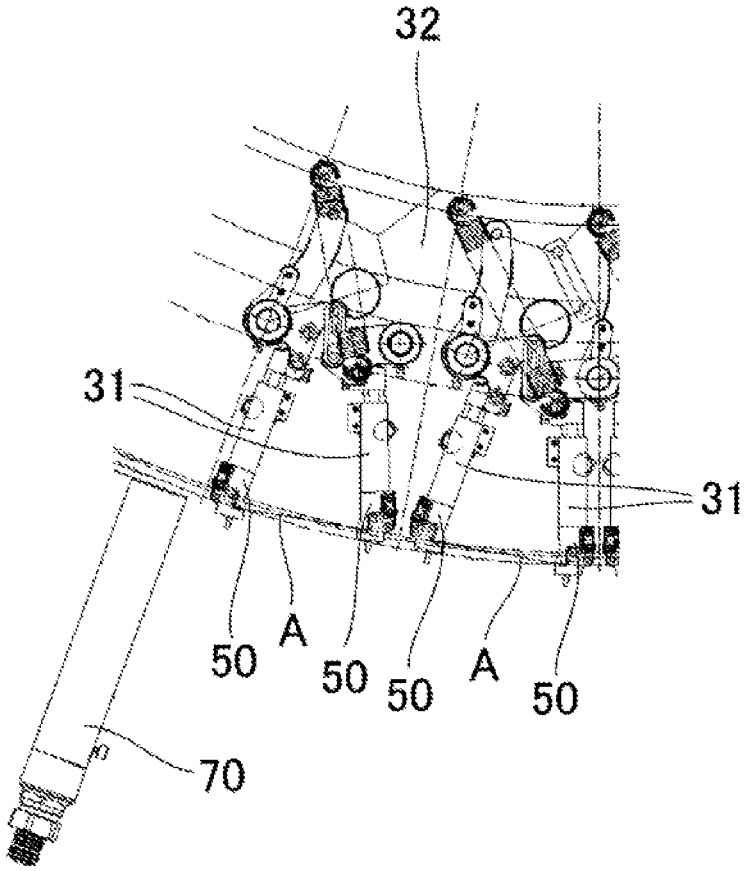
FIG. 8 is a partially enlarged plan view of the rotary packaging machine to explain an operation thereof in a printing step.
Figure 9:
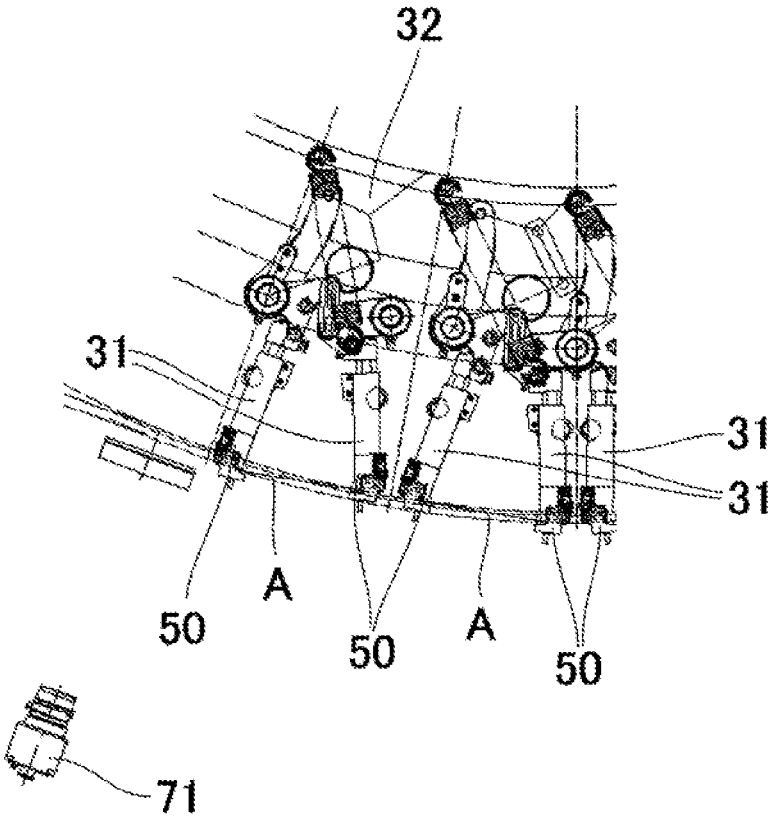
FIG. 9 is a partially enlarged plan view of the rotary packaging machine to explain an operation thereof in a sealing step.
Figure 10:
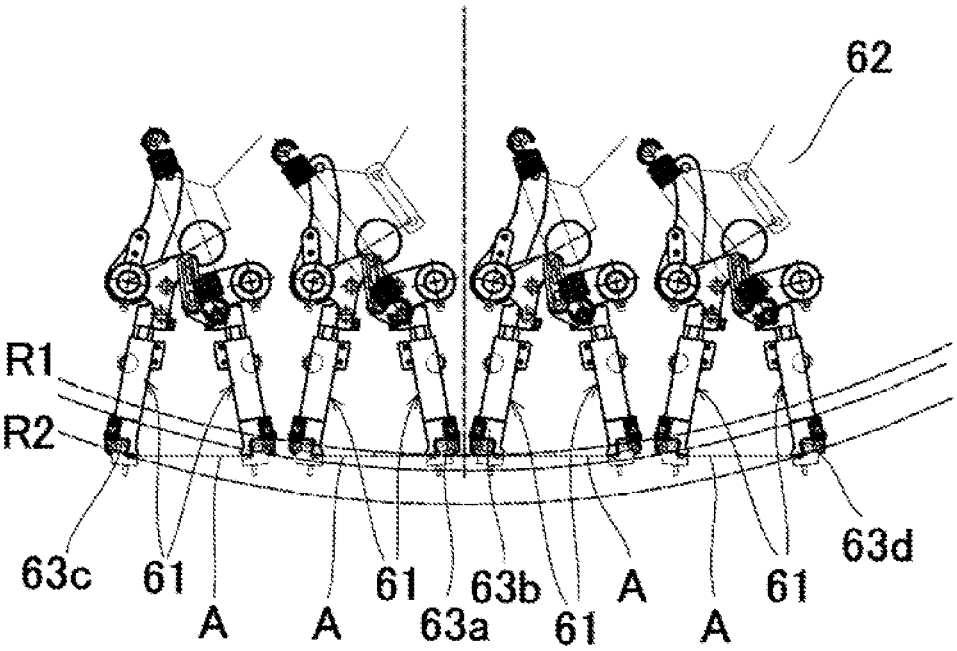
FIG. 10 is a partially enlarged plan view to explain four grip pairs installed in a conventional installation manner.
Figure 11:
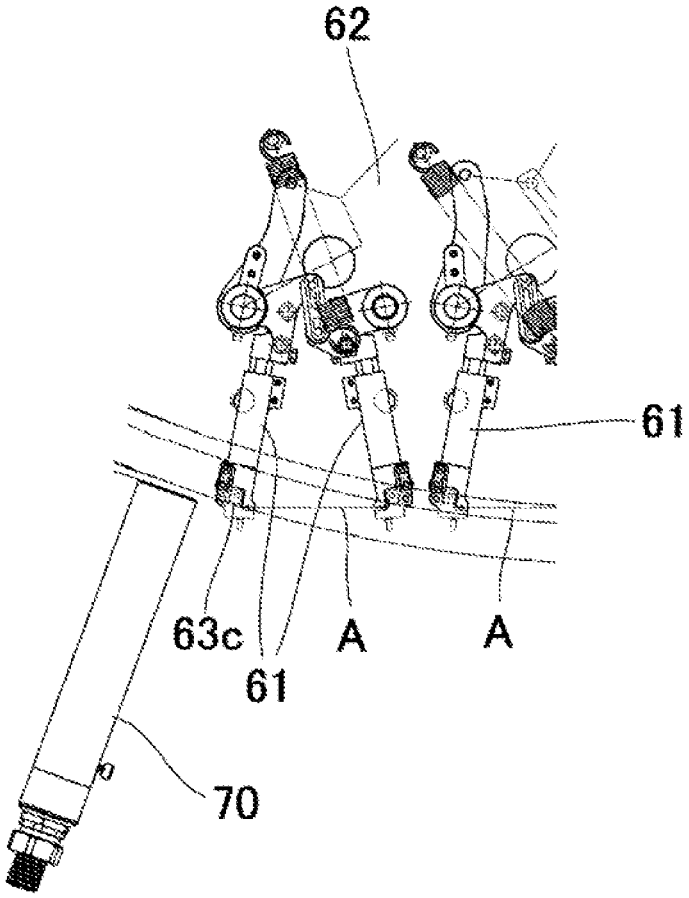
FIG. 11 is a partially enlarged plan view to explain an operation in the printing step in the case where four grip pairs are installed in the conventional installation manner.
Figure 12:
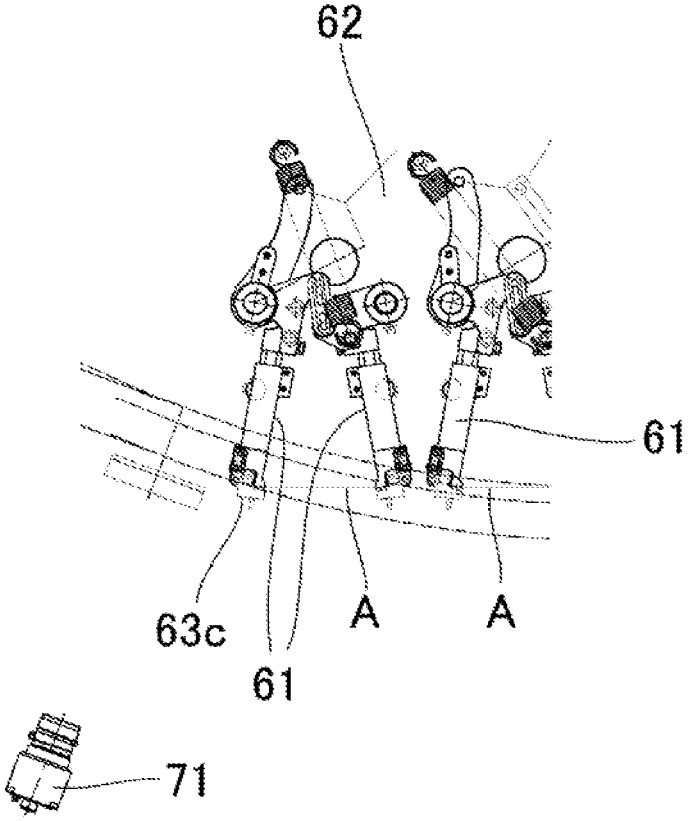
FIG. 12 is a partially enlarged plan view to explain an operation in the sealing inspection step in the case where four grip pairs are installed in the conventional installation manner.

More specifically, as illustrated in FIG. 8, since the distances between the packaging bags A held by the grips 50 and an ink-jet printer 70 are substantially equal to one another in the printing step, the printing quality is also substantially uniform. Furthermore, the inspection accuracy can be improved since the distances between the respective packaging bags A held by the grips 50 and the camera 71 are substantially equal to one another in the print inspection step, as illustrated in FIG. 9. Still furthermore, the weighing accuracy can be greatly improved without up-down movement of the articles in the packaging bags A since an equal centrifugal force is applied to the packaging bags A held by the grips 50 in the measurement step.

Furthermore, each grip pair 31 is mounted so that a midpoint m of the packaging bag A held by the grips 50 thereof in a planar view is located on the circumference L of the imaginary circle that is concentric with the disk-shaped rotating body 32, as illustrated in FIG. 1. Thus, various devices or apparatuses disposed at each packaging station can function more stably by improving a mounting accuracy of the grip pairs 31.

Figure 2:
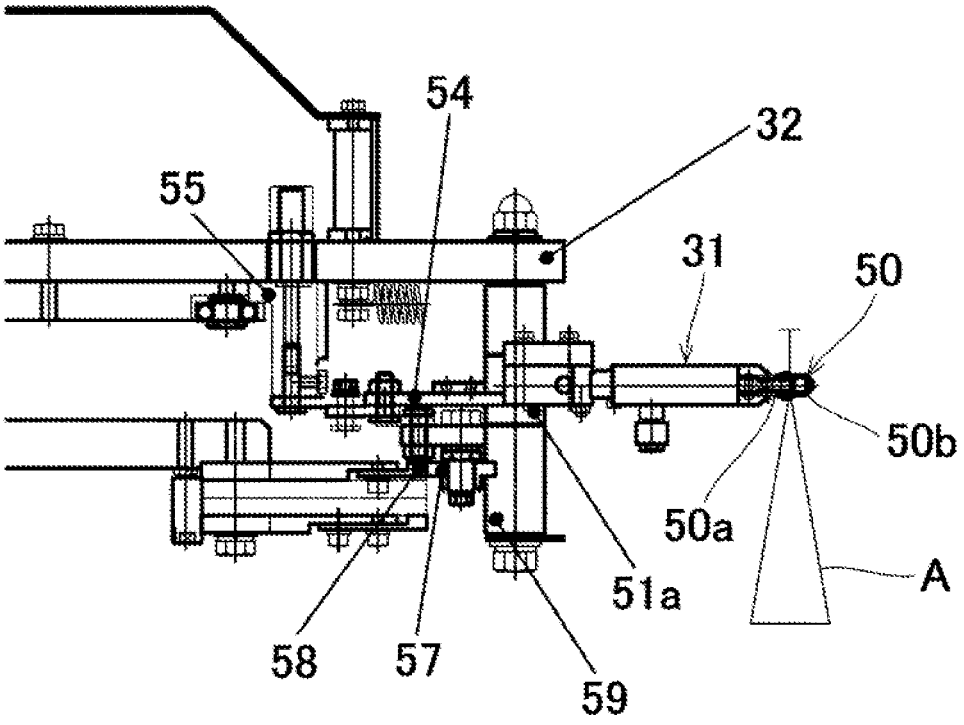
FIG. 2 is a partially enlarged left side view of the rotary packaging machine of the embodiment.
Figure 3:
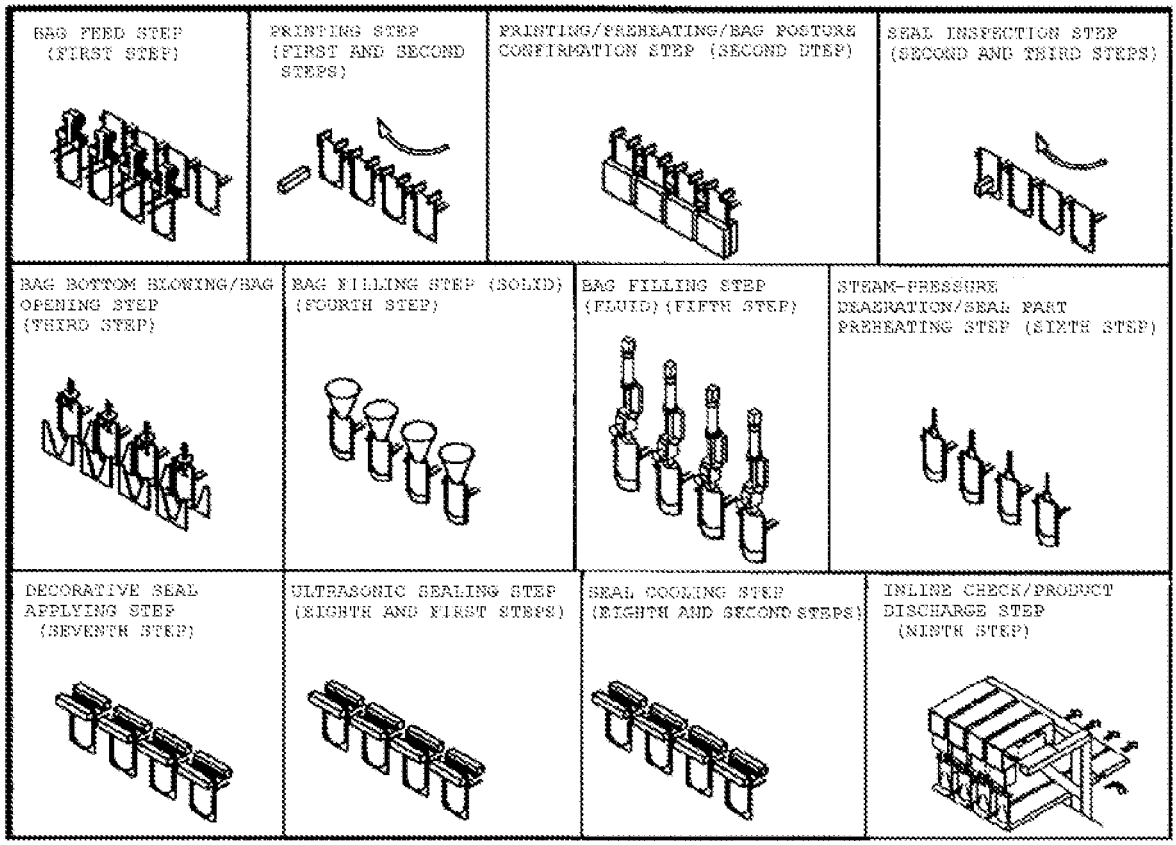
FIG. 3 is a diagrammatic view for explaining a packaging process of the rotary packaging machine.

Incidentally, mounting of the grip pairs rotated simultaneously with the disk-shaped rotating body in the rotary packaging machine includes not only those mounted directly on the disk-shaped rotating body but also those mounted indirectly on the disk-shaped rotating body. In the rotary packaging machine P of the embodiment, the grip pairs 31 are mounted indirectly on the disk-shaped rotating body 32 so as to project radially below the disk-shaped rotating body 32, as illustrated in FIGS. 1 and 2.

Each grip pair 31 has a left holder 51*a*, a grip 50 provided on a distal end of the left holder 51*a*, a right holder 51*b* and a grip 50 provided on a distal end of the right holder 51*b*, as illustrated in FIG. 1. The right and left holders 51*b* and 51*a* have respective proximal ends and are configured to be rotatable about respective supporting points 52*b* and 52*a* provided on the respective proximal end sides.

The proximal end sides of the right and left holders 51*b* and 51*a* are connected to each other by a link 53, so that both holders are configured to be operated simultaneously during claw adjustment. More specifically, a claw opening/closing lever 54 is fixed to the left holder 51*a*. Upon rotation of a claw width adjusting disk 55 in a direction of arrow h (clockwise) in FIG. 1, the movement of the disk 55 is transmitted via a claw width adjusting link body 56 to the claw opening/closing lever 54, so that a distance between the grips 50 of the right and left holders 51*b* and 51*a* (a claw width) is reduced, as shown by arrow j in FIG. 1. On the other hand, upon rotation of the claw width adjusting disk 55 in the counterclockwise direction in FIG. 1, the movement of the disk 55 is transmitted via the claw width adjusting link body 56 to the claw opening/closing lever 54, so that the distance between the grips 50 of the right and left holders 51*b* and 51*a* (the claw width) is increased.

Each grip 50 has a holding claw 50*a* movable at the distal end side and a fixed claw 50*b* fixed inside the holding claw 50*a*. The movable holding claw 50*a* is configured to be opened/closed by running a claw opening/closing roller 57 on a fixed cam 58. The claw opening/closing roller 57 is fixed to a lever 59 as illustrated in FIG. 2.

Next, the following will describe packaging stations in the rotary packaging machine P and a packaging process executed at each packaging station. The packaging machine P has a bag feed station 1, a printing/preheating/bag posture confirmation/seal inspection station 2, a bag bottom blowing/bag opening station 3, a bag filling station 4 (solids), a bag filling station 5 (fluids), a steam deaeration/seal part preheating station 6, a decorative seal applying station 7, an ultrasonic sealing station 8 and an inline check and product discharge station 9. The packaging process executed at each station will be described.

In the bag feed station 1, the packaging bags A conveyed by a bag feed conveyor are sequentially held by the intermittently moved grip pairs 31, so that the bag feed step (a first step) is carried out. More specifically, in the bag feed step (a first step), each packaging bag A, which is moved upward while being maintained in a vertical position by suckers, is held by a holding bar of a bag feed device to be transferred to the grip pairs 31 after correction of bag height.

In the printing/preheating/bag posture confirmation/seal inspection station 2, an expiration date or the like is printed by a sealing device (an ink-jet printer 70) on the reverse side of the packaging bag A supported in the vertical position by the grip pairs 31. Furthermore, the bottom vicinity of the packaging bag A is warmed from both sides of the packaging bag A by a warming device in order that the bottom of the packaging bag A may be opened (preliminary warming), and the position of the packaging bag A is confirmed (bag position confirmation). Still furthermore, a printed part is photographed by the camera 71 in order that printing may be checked to see if it is good or not (seal inspection).

In the bag bottom blowing/bag opening station 3, suckers are respectively caused to adhere to two sides of the packaging bag A supported in the vertical position by the grip pairs 31, in order that the bag mouth may be slightly opened, and thereafter, air is supplied into the packaging bag A so that the bag bottom is inflated.

In the bag filling station 4 (solids), a filling funnel is inserted through the bag mouth so that the packaging bag A is filled with articles (the solids).

In the bag filling station 5 (fluids), a filling funnel is inserted through the bag mouth so that the packaging bag A is filled with articles (the fluids).

In the steam deaeration/seal part preheating station 6, the steam deaeration is executed and thereafter, a seal part B (refer to FIG. 7) is previously heated so that water drops adhered to an inner side of the seal part B in the steam deaeration is vaporized thereby to be removed. More specifically, steam is discharged into the packaging bag A from a steam discharge nozzle of a steam deaerator. As a result, air is driven out of the packaging bag A so that a storage period of retort food is prolonged, and the steam is liquefied so that the volume of inner space is reduced. Subsequently, the seal part B of the packaging bag A is clamped by paired pre-heating bars from two sides of the packaging bag A, whereby the water drops adhered to the inner side of the seal part B is vaporized thereby to be removed.

In the decorative seal applying station 7, an upper part of the seal part B of the packaging bag A is clamped by paired sealing bars from both sides of the packaging bag A with the result that a decorative seal (cosmetic seal) D (refer to FIG. 7) is applied to the packaging bag A. By applying the decorative seal D prior to the ultrasonic seal C, water droplets that could not be removed by the preheating of the seal part B are allowed to escape to the upper and lower sides (inside and outside of the packaging bag A), and large bubbles can be prevented from remaining on the inside of the seal and wrinkles can be prevented from occurring in the seal part.

In the ultrasonic sealing station 8, a sealing horn of an ultrasonic sealer is pressed against a lower part of the seal part B of the packaging bag A so that the ultrasonic seal C (refer to FIG. 7) is applied to the packaging bag A with the result that the packaging bag A is completely sealed. Subsequently, the seal part B of the packaging bag A is held between paired cooling bars from the outside and inside of the packaging bag A so that fine bubbles generated on the decorative seal D are removed by the cooling bars, whereby perforations are formed.

In the inline check/product discharge station 9, the weight of the packaging bag A in which the article is packaged is measured, and the packaging bag A in which a suitable amount of article is packaged is discharged via a sorting chute to an external conveyor. The rotary packaging machine is configured so that the aforementioned sequential packaging process is carried out for the packaging bags A supported by the grip pairs 31 intermittently moved by the intermittent rotation of the disk-shaped rotating body 32 thereby to mass-produce packaged products of articles (retort food).

As described above, the rotary packaging machine P in accordance with the invention executes the packaging process at each of the above-described packaging stations for the packaging bags A simultaneously held by the four grip pairs 31, with the result that the production efficiency and the mass productivity can be improved. Furthermore, since the grips 50 of all the grip pairs 31 are configured to be located on the circumference L of the imaginary circle that is concentric with the disk-shaped rotating body 32, the difference between the inner and outer circular arcs where the grips 50 are located is almost eliminated, the rotary packaging machine P can be rendered smaller-sized and the footprint can be reduced. Still furthermore, various devices and apparatuses disposed at every station can stably function.

EXPLANATION OF REFERENCE SYMBOLS

P rotary packaging machine
1 bag supply station
2 printing/preheating/bag posture confirmation/seal inspection station
3 bag bottom blowing/bag opening station
4 bag filling station (solids)
5 bag filling station (fluids)
6 steam deaeration/seal part preheating station
7 decorative seal applying station
8 ultrasonic sealing station
9 inline check/product discharge station
31 grip pair
32 disk-shaped rotating body
33 intermittent rotating shaft
34 stand
35 machine base
50 grip
50*a* holding grip
50*b* fixed claw
51*a* left holder
51*b* right holder
52*a* supporting point
52*b* supporting point

53 link
54 claw opening/closing lever
55 claw width adjusting disk
56 claw width adjusting link body
57 claw opening/closing roller
58 fixed cam
59 lever
70 ink-jet printer
71 camera
A packaging bag
B seal part
C ultrasonic seal
D decorative seal

The invention claimed is:

1. A rotary packaging machine in which a grip pair holding vicinities of both sides of a bag mouth of a packaging bag is intermittently moved to each of a plurality of packaging stations together with a disk-shaped rotating body, so that an article is packaged in the packaging bag, wherein the rotary packaging machine comprising four grip pairs which are disposed at each of the plurality of packaging stations and which are intermittently moved to each of the plurality of packaging stations simultaneously, wherein the four grip pairs include grips which are located at a substantially pre-determined equidistance from a center of the disk-shaped rotating body, wherein the four grip pairs are mounted so that a midpoint of the packaging bag held by the grips of the four grip pairs in a planar view is located on a circumference of an imaginary circle that is concentric with the disk-shaped rotating body, wherein each four grip pair has a left holder and a left grip provided on a distal end of the left holder, and a right holder and a right grip provided on a distal end of the right holder, wherein the right and left holders have respective proximal ends and are configured to be rotatable about respective supporting points provided on respective proximal end sides, wherein the respective proximal end sides of the right and left holders are connected to each other by a link, wherein the rotary packing machine further comprises a claw opening/closing lever fixed to the left holder, a claw width adjusting disk, and a claw width adjusting link body connecting the claw opening/closing lever and the claw width adjusting disk, wherein the claw width adjusting link body is pivotally connected to the claw opening/closing lever and pivotally connected to the claw width adjusting disk, and upon rotation of the claw width adjusting disk in a clockwise direction, a movement of the disk is transmitted via the claw width adjusting link body to the claw opening/closing lever so that a distance between the grips of the right and left holders is reduced, and upon rotation of the claw width adjusting disk in a counterclockwise direction, the movement of the claw width adjusting disk is transmitted via the claw width adjusting link body to the claw opening/closing lever, so that a distance between the grips of the right and left holders is increased.

2. The rotary packaging machine according to claim 1, wherein the respective proximal end sides of the right and left holders are connected to each other by a link, so that the right and left holders are configured to be operated simultaneously while adjusting the right and left holders.

3. The rotary packaging machine according to claim 1, wherein each grip has a holding claw movable at a distal end side and a fixed claw located inward and fixed inside the holding claw, and wherein the holding claw is configured to be opened or closed by running a claw opening or closing roller on a fixed cam, and the claw opening or closing roller is fixed to a lever which is a part of a rotating stand.

4. The rotary packaging machine according to claim 1, wherein the plurality of packaging stations is nine packing stations.

* * * * *